United States Patent [19]

Entringer

[11] Patent Number: 4,753,618

[45] Date of Patent: Jun. 28, 1988

[54] SHIFT CABLE ASSEMBLY FOR MARINE DRIVE

[75] Inventor: David C. Entringer, Fond du Lac, Wis.

[73] Assignee: Brunswick Corporation, Skokie, Ill.

[21] Appl. No.: 63,139

[22] Filed: Jun. 16, 1987

[51] Int. Cl.[4] ..... B63H 5/06

[52] U.S. Cl. ..... 440/86; 440/84; 123/198 DC; 74/851; 74/DIG. 8

[58] Field of Search ..... 440/84, 86, 87, 1, 75; 123/198 DC, 334, 335, 630; 74/851, 852, 843, 861; 192/0.062, 0.08

[56] References Cited

U.S. PATENT DOCUMENTS

| | | | |
|---|---|---|---|
| 3,165,941 | 1/1965 | Morse | 74/DIG. 8 |
| 4,231,316 | 11/1980 | Bland et al. | 440/86 |
| 4,262,622 | 4/1981 | Dretzka | 440/86 |
| 4,403,970 | 9/1983 | Dretzka et al. | 440/86 |
| 4,432,734 | 2/1984 | Bland | 440/86 |
| 4,525,149 | 6/1985 | Broughton | 440/86 |
| 4,531,487 | 7/1985 | Fujikawa | 123/198 DC |

FOREIGN PATENT DOCUMENTS

| | | | |
|---|---|---|---|
| 871674 | 3/1983 | Fed. of Rep. of Germany | 74/851 |

*Primary Examiner*—Sherman D. Basinger
*Assistant Examiner*—Clifford T. Bartz
*Attorney, Agent, or Firm*—Andrus, Sceales, Starke & Sawall

[57] ABSTRACT

A shift cable assembly for a marine drive includes a shift plate, a shift lever pivotally mounted on the plate, and a switch actuating arm pivotally mounted on the plate between a first neutral position and a second switch actuating position. A control cable and drive cable interconnect the shift lever and switching actuating arm with a remote control and clutch and gear assembly for the marine drive so that shifting of the remote control by a boat operator moves the cables to pivot the shift lever and switch actuating arm which in turn actuates a shift interrupter switch mounted on the plate to momentarily interrupt ignition of the drive unit to permit easier shifting into forward, neutral and reverse gears. A spring biases the arm into its neutral position and the arm includes an improved mounting for retaining the spring in its proper location on the arm.

8 Claims, 2 Drawing Sheets

SHIFT CABLE ASSEMBLY FOR MARINE DRIVE

BACKGROUND OF THE INVENTION

The present invention relates to marine drives, and more particularly to a shift cable assembly for a marine drive.

Shift cable assemblies for marine drives typically include a shift actuating arm which is pivoted upon the movement of a remote control by a boat operator between forward neutral and reverse positions to actuate a shift interrupter switch to momentarily interrupt ignition of the marine drive unit by grounding the coil. This momentary ignition interruption essentially "kills" the engine for a short time period to enable easier shifting by the operator into forward or reverse gears by momentarily reducing the load on the gears.

SUMMARY OF THE INVENTION

A shift cable assembly for a marine drive includes a shift plate, a shift lever pivotally mounted on the plate, and a switch actuating arm pivotally mounted on the plate between a first neutral position and a second switch actuating position. A control cable and drive cable interconnect the shift lever and switching actuating arm with a remote control and clutch and gear assembly, respectively, for the marine drive so that shifting of the remote control by a boat operator moves the cables to pivot the shift lever and switch actuating arm which in turn actuates a shift interrupter switch mounted on the plate to momentarily interrupt ignition of the drive unit to permit easier shifting into forward, neutral and reverse gears. A spring biases the arm into its neutral position and the arm includes an improved mounting for retaining the spring in its proper location on the arm.

The spring means is disposed on one side of the arm parallel thereto and includes a V-shaped spring member having a head and a pair of legs diverging therefrom. The mounting means on the switch actuating arm includes first retaining means for retaining the head of the spring member on the arm and second retaining means spaced from the first retaining means and adjacent the legs of the spring member for retaining the legs on the arm. Preferably, the first retaining means includes an L-shaped boss projecting from the arm and defining a spring head-receiving slot extending parallel to the arm. The boss includes one end attached to the arm and the other end extending parallel to the arm and spaced therefrom. The second retaining means includes a pair of U-shaped bosses projecting from the arm and defining spring leg-receiving openings. The U-shaped bosses are located adjacent opposite edges of the arm and each includes opposite spaced apart walls projecting from the arm and a cross member interconnecting the outer ends of the walls. One of the walls of each boss defines an abutment surface for engagement with the spring legs when the arm is in its neutral position.

The switch actuating arm is composed of a plastics material to avoid machining and thus obtain reduced cost. Also, the arm being composed of plastics material avoids the wearing and deterioration of parts caused by vibration which might otherwise occur between metallic components, as utilized with prior art devices.

Other features and advantages of the invention will become apparent to those skilled in the art upon reviewing the following detailed description, the drawings, and the appended claims.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
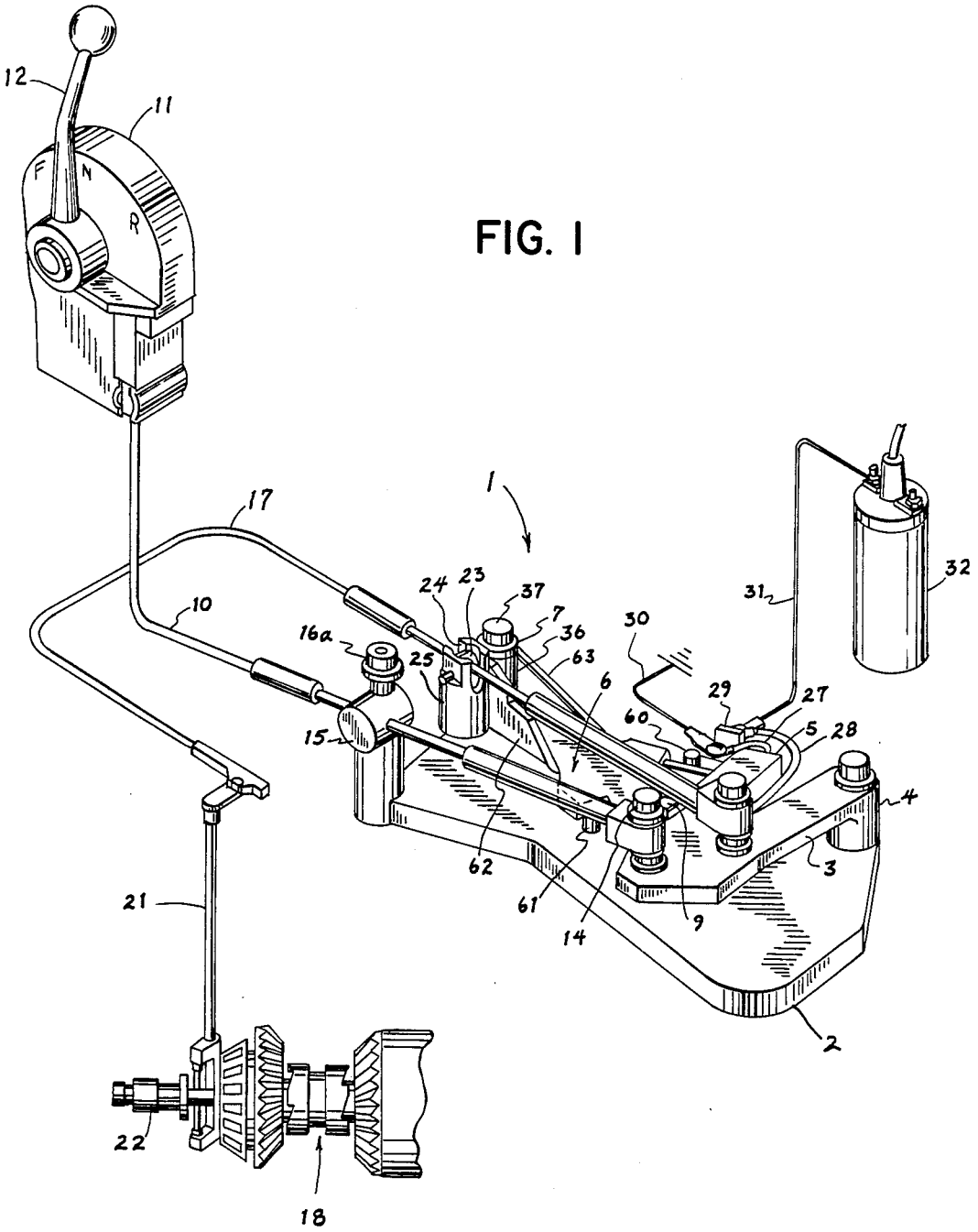
FIG. 1 is a schematic view illustrating a shift cable assembly for a marine drive which incorporates a shift plate assembly having a switch actuating arm constructed in accordance with the principles of the present invention.
Figure 2:
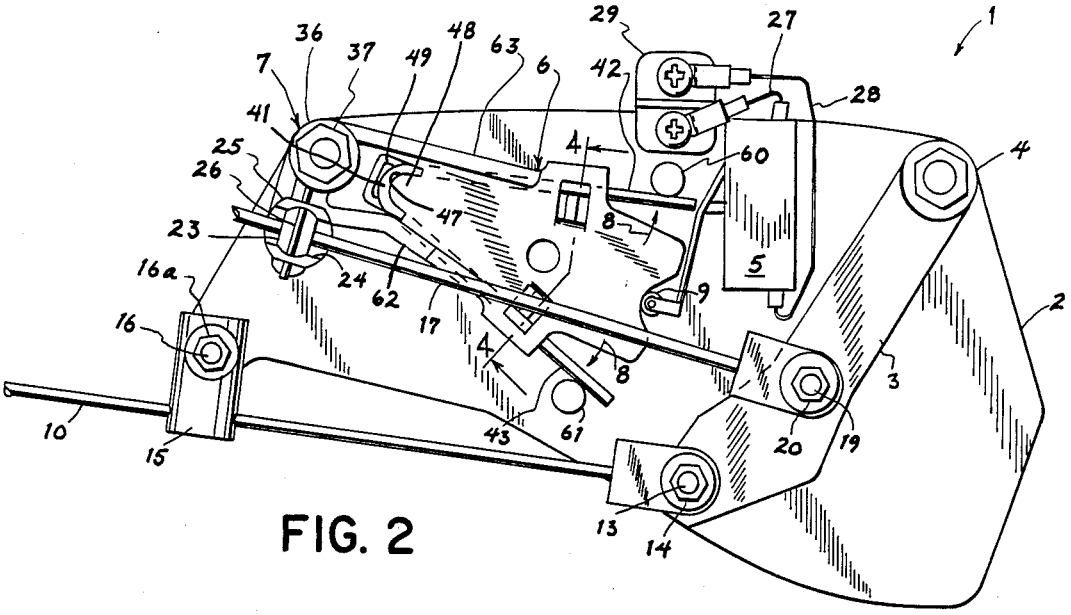
FIG. 2 is an enlarged plan view of the shift plate assembly shown in FIG. 1.

Referring now to the drawings, FIG. 1 illustrates a shift cable assembly for a marine drive with FIG. 2 illustrating a plan view of a shift plate assembly 1 incorporated in the shift cable assembly shown in FIG. 1. The shift plate assembly 1 includes a shift plate 2 mounted, for example, at the stern or rear of a boat. A shift lever 3 is pivotally mounted as at 4 at one end on plate 2. Shift lever 3 rotates freely about pivot connection 4 with respect to plate 2. Shift plate assembly 1 also includes a shift interrupter switch 5 mounted on plate 2 and actuatable to momentarily interrupt ignition of the drive unit, as will hereinafter be described. A switch actuating arm 6 is pivotally mounted as at 7 on plate 2 adjacent switch 5 between a first neutral position, as shown in FIGS. 1 and 2, and a second switching actuating position on either side of its neutral position, as indicated by the arrows 8 in FIG. 2. The pivoting of arm 6 raises a roller 9 connected to switch 5 which in turn closes the contacts within switch 5 to momentarily interrupt ignition of the drive unit, as will hereinafter be described.

As shown best in FIG. 1, a control cable 10 interconnects a remote control box 11 with shift lever 3. Remote control box 11 is generally located in the front of the boat adjacent the steering wheel (not shown), and includes a shift control arm 12 movable between a forward drive position F, a rearward drive position R and a neutral position N. Control cable 10 has one end connected to arm 12 in control box 11 and its other end connected to the outer or free end of shift lever 3. Cable 10 is connected to the outer end of lever 3 by a stud or anchor pin 13 and nut 14. An intermediate portion of control cable 10 is also supported by shift plate 2 by means of a guide barrel member 15. Barrel member 15 is cylindrical in shape and includes a radial opening therethrough at one end which slidably receives cable 10. Barrel member 15 also includes a second radial opening extending through its opposite end in a direction transverse to the opening that slidably receives cable 10 which receives a stud or anchor pin 16 projecting from plate 2. A nut 16a threadedly engaged and turned down on stud 16 completes the anchoring of barrel member 15 on stud 16. Thus, movement of shift arm 12 on remote control box 11 moves cable 10 so as to pivot shift lever 3. For example, movement of arm 12 from neutral position N to forward position F pulls cable 10 toward control box 11 to pivot lever 3 in a clockwise direction whereas movement of arm 12 from its neutral position into its reverse position R pushes cable 10 toward shift plate 2 resulting in shift lever 3 being pivoted in a counterclockwise direction.

A drive cable 17 interconnects shift lever 3, switch actuating arm 6 and a clutch and gear assembly 18 for the marine drive unit (not shown). More specifically, one end of cable 17 is connected to shift lever 3 at a location which is intermediate the opposite ends of lever 3 by means of an adjustable stud or anchor pin 19 and nut 20. The opposite end of cable 17 is attached to a shift shaft 21 which in turn is connected to a shift spool 22 for clutch and gear assembly 18. An intermediate portion of drive cable 17 is also connected or anchored to switch actuating arm 6. This intermediate connection includes a barrel member 23 attached to cable 17 which is received within a slot 24 formed in an upstanding boss 25 projecting from actuating arm 6. A cotter pin 26 extends through the upstanding sides of boss 25 and holds barrel 23 within slot 24. Thus, movement of drive cable 17 by shift lever 3 will result in pivotal movement of switch actuating arm 6 as well as shift spool 22. For example, if shift lever 3 pivots clockwise to push drive cable 17 switch actuating arm 6 will pivot about its connection 7 in a counterclockwise direction and shift shaft 21 will rotate to move shift spool 22 to cause clutch and gear assembly 18 to move into forward gear. On the other hand, if shift lever 3 pivots in a counterclockwise direction, it pulls drive cable 17 to pivot switching actuating arm 6 about its connection 7 in a clockwise direction and moves shift shaft 21 and spool 22 to engage clutch and gear assembly 18 in reverse gear. Movement of shift lever 3 is thus dependent upon the movement of shift arm 12 of remote control box 11 into the desired forward, neutral or reverse gear.

As shown best in FIG. 2, pivoting movement of switch actuating arm 6 in either direction, i.e. into either switch actuating position, will raise roller 9 of switch 5 to close the switch contacts within switch 5. Switch 5 in turn is connected via wires 27, 28 to a terminal block 29 which in turn (FIG. 1) is connected via wire 30 to ground and wire 31 to coil 32 of the ignition system for the marine drive. Thus, the closing of the switch contacts within switch 5 grounds coil 32 so that a momentary interruption in the ignition of the engine results. This momentary interruption in the ignition advantageously "kills" the engine of the marine drive unit for a short period of time to relief or reduce the load on the drive gears to enable easier shifting of control shift arm 12 by an operator.

Figure 3:
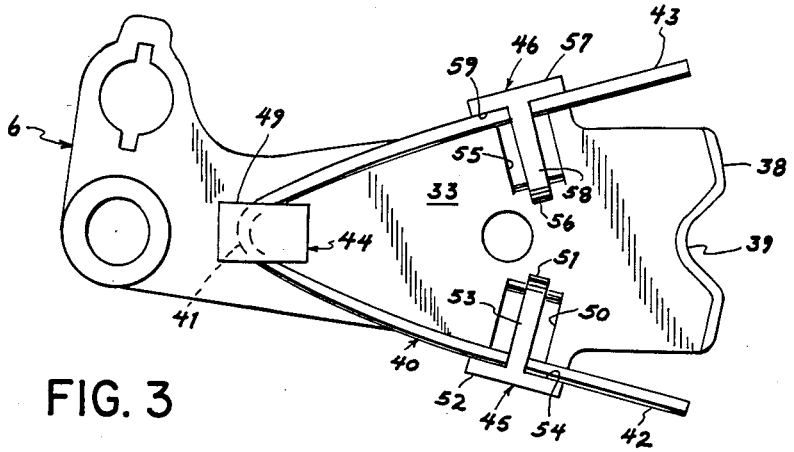
FIG. 3 is a bottom plan view of the switch actuating arm of FIG. 2.
Figure 4:
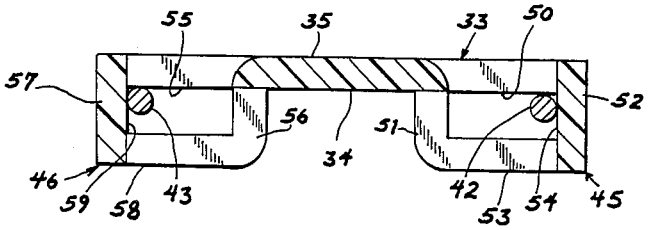
FIG. 4 is a cross sectional view taken along the plane of the line 4—4 in FIG. 2.

Referring now to FIGS. 3 and 4, there is illustrated switch actuating arm 6 in detail. Switch actuating arm 6 is in the form of a flat body member 33 disposed parallel to shift plate 2 and having an inner side 34, and an outer side 35. Upstanding boss 25 projects from outer side 35 of body 33, and is disposed at one end of body 33. As shown best in FIG. 2, pivot connection 7 is located adjacent boss 25 at the same end of body 33 and includes cylinder 36 projecting from outer side 35 of body 33 and a pin 37 extending therethrough into plate 2 to allow free rotation for switch actuating arm 6 with respect to shift plate 2. Boss 25 and cylinder 36 are supported by upstanding walls 62, 63 on opposite edges of arm 6.

At the end opposite from boss 25 and cylinder 36 on switching actuating arm 6 is a channel or track 38 which receives roller 9 of switch 5. Track 38 includes a recessed portion 39 intermediate its ends which corresponds to the neutral position for switching actuating arm 6 when roller 9 is disposed therein. The opposite raised ends of track 38 correspond to switching actuating positions for roller 9 of switch 5 when roller 9 is disposed thereon.

A spring 40 is disposed on the inner side 34 of body 33 and parallel thereto. Spring 40 biases switch actuating arm 6 into its neutral position and functions to return arm 6 to its neutral position from one of its switch actuating positions to insure that the ignition is only interrupted momentarily for a short period of time. Thus, the spring force of spring 30 must be greater than the frictional force in cables 10 and 17. Spring 40 is a V-shaped spring member having a head 41 and a pair of legs 42, 43 diverging therefrom.

Spring 40 is mounted on the inner side 34 of body 33 by means of a first retaining member 44 for head 41, a second retaining member 45 for leg 42 and a third retaining member 46 for leg 43. Retaining member 44 includes an L-shaped boss projecting from inner side 34 of body 33 which defines a spring head receiving slot 47 (FIG. 2) extending parallel to body 33. The L-shaped boss 44 has one wall 48 integrally attached to the inner side 34 of body 33 and its other wall 49 extending parallel to body 33 and spaced therefrom to define slot 47. Wall 48 is arc shaped to substantially correspond to the arc shape of head 41, and wall 49 of retaining member 44 is in the form of a flat rectangular shaped member. Thus, wall 48 prevents spring 40 from moving to the right as shown in FIG. 3 while wall 49 prevents head 41 of spring 40 from being raised off of inner side 34 of body 33 so as to hold head 41 in its proper location.

As shown best in FIGS. 3 and 4, retaining member 45 includes a U-shaped boss projecting from inner side 34 of body 33 which defines a spring leg-receiving opening 50. U-shaped boss 45 is located adjacent the edge of body 33 intermediate track 38 and boss 25. U-shaped boss 45 includes opposite spaced apart walls 51, 52 projecting from side 34 and a cross member 53 spaced from inner side 34 and interconnecting the outer ends of walls 51, 52. Wall 52 defines an abutment surface 54 for engagement with spring leg 42 when arm 6 is in its neutral position.

Similarly, retaining member 46 includes a U-shaped boss projecting from side 34 of body 33 along the opposite edge from retaining member 45 and defines a spring leg-receiving opening 55. U-shaped boss 46 includes opposite spaced apart walls 56, 57 integrally attached to side 34 of body 33 and projecting therefrom, and a cross member 58 spaced from inner side 34 and interconnecting the outer ends of walls 56, 57. Wall 57 also defines an abutment surface 59 which engages leg 43 of spring 40 when switch actuating arm 6 is in its neutral position.

As shown best in FIG. 4, retaining members 45 and 46 are identical in structure. Walls 51, 52 and 56, 57 of retaining members 45, 46 respectively prevent excessive lateral movement of spring 40 while cross members 53, 58 prevent legs 42, 43 from moving away from inner side 34 of body 33 to insure that spring 40 is held in its proper position.

The outer side of legs 42, 43 of spring 40 engage respectively bosses or upstanding pins 60, 61 projecting from side 34 of body 33. The engagement of legs 42, 43 with bosses 60, 61 results in the contraction of legs 42, 43 when switching actuating arm 6 is pivoted to one of its switching actuating positions so as to provide the spring force to return arm 6 to its neutral position, as previously described herein.

Various modes of carrying out the invention are contemplated as being within the scope of the following claims particularly pointing out and distinctly claiming the subject matter which is regarded as the invention.

I claim:

1. A shift cable assembly for a marine drive, comprising:

a shift plate;

a shift lever pivotally mounted on said plate;

remote control means for selectively positioning a clutch and gear assembly of a drive unit into forward, neutral and reverse gears;

control cable means interconnecting said remote control means and said shift lever and movable by said remote control means to pivot said shift lever;

shift interrupter switch means mounted on said plate and actuatable to momentarily interrupt ignition of the drive unit;

a switch actuating arm pivotally mounted on said plate between a first neutral position and a second switch actuating position, said arm including a flat body member disposed parallel to said shift plate;

spring means for biasing said arm into said neutral position, said spring means disposed on one side of said arm parallel thereto and including a V-shaped spring member having a head and a pair of legs diverging therefrom;

mounting means on said switch actuating arm for mounting said spring means on said arm, said mounting means including first retaining means for retaining the head of said spring member on said one side of said arm and second retaining means spaced from said first retaining means and adjacent the legs of said spring member for retaining the legs of said spring member on said one side of said arm; and drive cable means interconnecting said shift lever and said clutch and gear assembly and having an intermediate portion connected to said switch actuating arm and movable to pivot said switch actuating arm to said second switch actuating position in response to pivoting of said shift lever by said control cable means.

2. The shift cable assembly of claim 1 wherein said first and second retaining means are integral with said switch actuating arm.

3. The shift cable assembly of claim 1 wherein said first retaining means includes an L-shaped boss projecting from said one side of said arm and defining a spring head-receiving slot extending parallel to said arm.

4. The shift cable assembly of claim 3 wherein said L-shaped boss includes one wall attached to said one side of said arm and another wall extending parallel to said arm and spaced therefrom.

5. The shift cable assembly of claim 1 wherein said second retaining means includes a pair of U-shaped bosses projecting from said one side of said arm and defining spring leg-receiving openings.

6. The shift cable assembly of claim 5 wherein said U-shaped bosses are located adjacent opposite edges of said arm.

7. The shift cable assembly of claim 6 wherein each of said U-shaped bosses include opposite spaced apart walls attached to said one side of said arm and projecting therefrom and a cross member spaced from said one side interconnecting said walls, and one of the walls of each boss defines an abutment surface for engagement with a spring leg when said arm is in its neutral position.

8. The shift cable assembly of claim 2 wherein said switch actuating arm is composed of plastics material.

* * * * *